US010746124B2

(12) United States Patent
Radeczky

(10) Patent No.: US 10,746,124 B2
(45) Date of Patent: Aug. 18, 2020

(54) METHOD FOR ADAPTING AN INJECTION QUANTITY

(71) Applicant: Continental Automotive GmbH, Hannover (DE)

(72) Inventor: Janos Radeczky, Wenzenbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 211 days.

(21) Appl. No.: 14/785,914

(22) PCT Filed: Apr. 16, 2014

(86) PCT No.: PCT/EP2014/057680
§ 371 (c)(1),
(2) Date: Oct. 21, 2015

(87) PCT Pub. No.: WO2014/173742
PCT Pub. Date: Oct. 30, 2014

(65) Prior Publication Data

US 2016/0069290 A1 Mar. 10, 2016

(30) Foreign Application Priority Data

Apr. 25, 2013 (DE) ..... 10 2013 207 555

(51) Int. Cl.
*F02D 41/24* (2006.01)
*F02D 41/30* (2006.01)
(Continued)

(52) U.S. Cl.
CPC ..... *F02D 41/247* (2013.01); *F02D 41/123* (2013.01); *F02D 41/1497* (2013.01);
(Continued)

(58) Field of Classification Search
CPC .. F02D 41/247; F02D 41/1497; F02D 41/123; F02D 41/3076; F02D 2200/0614; F02D 2200/1002
See application file for complete search history.

(56) References Cited

U.S. PATENT DOCUMENTS 5,070,836 A 12/1991 Wahl et al. ..... 123/299
6,367,769 B1 4/2002 Reiter et al. ..... 251/129
(Continued)

FOREIGN PATENT DOCUMENTS

CN 102787926 A 11/2012 ..... F02D 41/06
CN 102985670 A 3/2013 ..... F02D 41/22
(Continued)

OTHER PUBLICATIONS

U.S. Non-Final Office Action, U.S. Appl. No. 14/783,939, 17 pages, dated Jan. 27, 2017.
(Continued)

*Primary Examiner* — Tuan C To
*Assistant Examiner* — Kelly D Williams
(74) *Attorney, Agent, or Firm* — Slayden Grubert Beard PLLC

(57) ABSTRACT

A method for adapting an injection quantity in an injection system of an internal combustion engine of a mild-hybrid motor vehicle or motor vehicle having a starter-generator or integrated starter-generator is disclosed. In an operating phase in which the e-machine of the motor vehicle drives the internal combustion engine, at least one small-quantity test injection is performed into a cylinder of the internal combustion engine. The associated injection quantity is determined based on a resulting torque. Corresponding correction variables for the adaptation of the injection quantity are
(Continued)

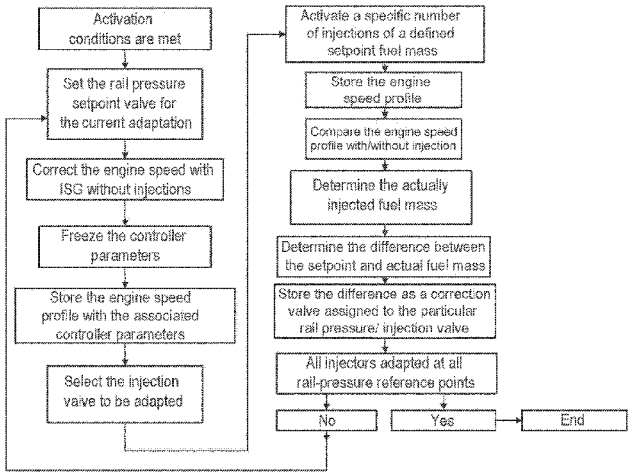

determined therefrom. The method may eliminate the need to perform test injections during overrun phases of the internal combustion engine.

4 Claims, 1 Drawing Sheet

(51) Int. Cl.
*F02D 41/14* (2006.01)
*F02D 41/12* (2006.01)

(52) U.S. Cl.
CPC .. *F02D 41/3076* (2013.01); *F02D 2200/0614* (2013.01); *F02D 2200/1002* (2013.01)

(56) References Cited

U.S. PATENT DOCUMENTS

| | | | | |
|---|---|---|---|---|
| 6,520,434 | B1 | 2/2003 | Reiter et al. | 239/585 |
| 6,783,109 | B2 | 8/2004 | Ogura et al. | 251/129 |
| 6,994,281 | B2 | 2/2006 | Reiter | 239/533 |
| 7,073,485 | B2 | 7/2006 | Truscott et al. | 123/406.22 |
| 7,139,657 | B2 | 11/2006 | Bouchain et al. | 701/104 |
| 7,506,827 | B2 | 3/2009 | Petrone et al. | 239/585 |
| 7,815,128 | B2 | 10/2010 | Beilharz et al. | 239/5 |
| 8,430,343 | B2 | 4/2013 | Nagatomo | 239/585 |
| 8,620,500 | B2 | 12/2013 | Becker et al. | 701/22 |
| 8,973,893 | B2 | 3/2015 | Lehner et al. | 251/129.06 |
| 9,435,305 | B2 | 9/2016 | Mechi | |
| 2005/0199221 | A1* | 9/2005 | Dietl | F02D 41/062 123/490 |
| 2006/0293829 | A1 | 12/2006 | Cornwell et al. | 701/114 |
| 2009/0164086 | A1 | 6/2009 | Geveci et al. | 701/102 |
| 2012/0013325 | A1 | 1/2012 | Tonner et al. | 324/104 |
| 2013/0024098 | A1* | 1/2013 | Li | F02D 41/1497 701/104 |
| 2013/0167809 | A1 | 7/2013 | Siedentopf et al. | 123/478 |
| 2013/0255639 | A1 | 10/2013 | Guillen Castillo et al. | 123/472 |
| 2014/0346244 | A1 | 11/2014 | Russe et al. | 239/4 |

FOREIGN PATENT DOCUMENTS

| | | | | |
|---|---|---|---|---|
| DE | 10257686 | A1 | 7/2004 | F02D 41/12 |
| DE | 10305523 | A1 | 8/2004 | F02D 41/22 |
| DE | 10345967 | A1 | 4/2005 | F02M 51/06 |
| DE | 102006048979 | A1 | 4/2008 | F02D 41/20 |
| DE | 102008000587 | A1 | 10/2008 | F02D 41/40 |
| DE | 102008000911 | A1 | 10/2009 | B60W 10/06 |
| DE | 102009000741 | A1 | 8/2010 | H01F 7/18 |
| DE | 102009009270 | A1 | 8/2010 | F02D 41/20 |
| DE | 102010017093 | A1 | 12/2010 | F02D 41/20 |
| DE | 102010021169 | A1 | 11/2011 | F02D 41/00 |
| DE | 102011075732 | A1 | 11/2012 | F02D 41/20 |
| DE | 102011076363 | A1 | 11/2012 | F02M 65/00 |
| DE | 102010014320 | B4 * | 10/2016 | F02D 41/1497 |
| EP | 0416265 | A1 | 3/1991 | F02D 41/20 |
| EP | 2527637 | A1 | 11/2012 | F02M 51/06 |
| EP | 2538061 | A2 | 12/2012 | F02D 41/20 |
| GB | 2397851 | A * | 8/2004 | F02D 41/2438 |
| GB | 2397851 | A | 8/2004 | F02D 41/24 |
| GB | 2498533 | A | 7/2013 | B60K 6/00 |
| GB | 2498783 | A | 7/2013 | F02D 41/22 |
| JP | 2010096075 | A | 4/2010 | F02M 51/06 |
| JP | 2011137442 | A | 7/2011 | F02M 51/06 |
| JP | 2011190798 | A | 9/2011 | F02M 51/06 |
| JP | 2012172594 | A | 9/2012 | F02M 51/06 |
| WO | 02/084102 | A1 | 10/2002 | F02M 51/06 |
| WO | 03/081007 | A1 | 10/2003 | F02D 41/20 |
| WO | 2004/074673 | A1 | 9/2004 | F02M 51/06 |
| WO | 2009/019584 | A2 | 2/2009 | B60K 6/24 |
| WO | 2012/076561 | A1 | 6/2012 | B60W 10/08 |
| WO | 2013/026978 | A1 | 2/2013 | B60K 6/20 |
| WO | 2014/167134 | A1 | 10/2014 | F02D 41/20 |
| WO | 2014/173742 | A1 | 10/2014 | F02D 41/12 |
| WO | 2014/173920 | A1 | 10/2014 | F02M 51/06 |

OTHER PUBLICATIONS

Chinese Office Action, Application No. 201480020859.7, 16 pages, dated Feb. 28, 2017.
European Search Report, Application No. 13165546.6, 8 pages, dated Oct. 14, 2013.
German Office Action, Application No. 102013206600.7, 7 pages, dated Dec. 12, 2013.
German Office Action, Application No. 102013207555.3, 5 pages, dated Jan. 23, 2014.
International Search Report and Written Opinion, Application No. PCT/EP2014/057477, 20 pages, dated Aug. 7, 2014.
International Search Report and Written Opinion, Application No. PCT/EP2014/057680, 18 pages, dated Aug. 11, 2014.
Japanese Office Action, Application No. 2016509442, 6 pages, dated Jun. 27, 2016.
Chinese Office Action, Application No. 201480023513.2, 13 pages, dated Jun. 19, 2017.
U.S. Final Office Action, U.S. Appl. No. 14/783,939, 11 pages, dated Jul. 24, 2017.

* cited by examiner

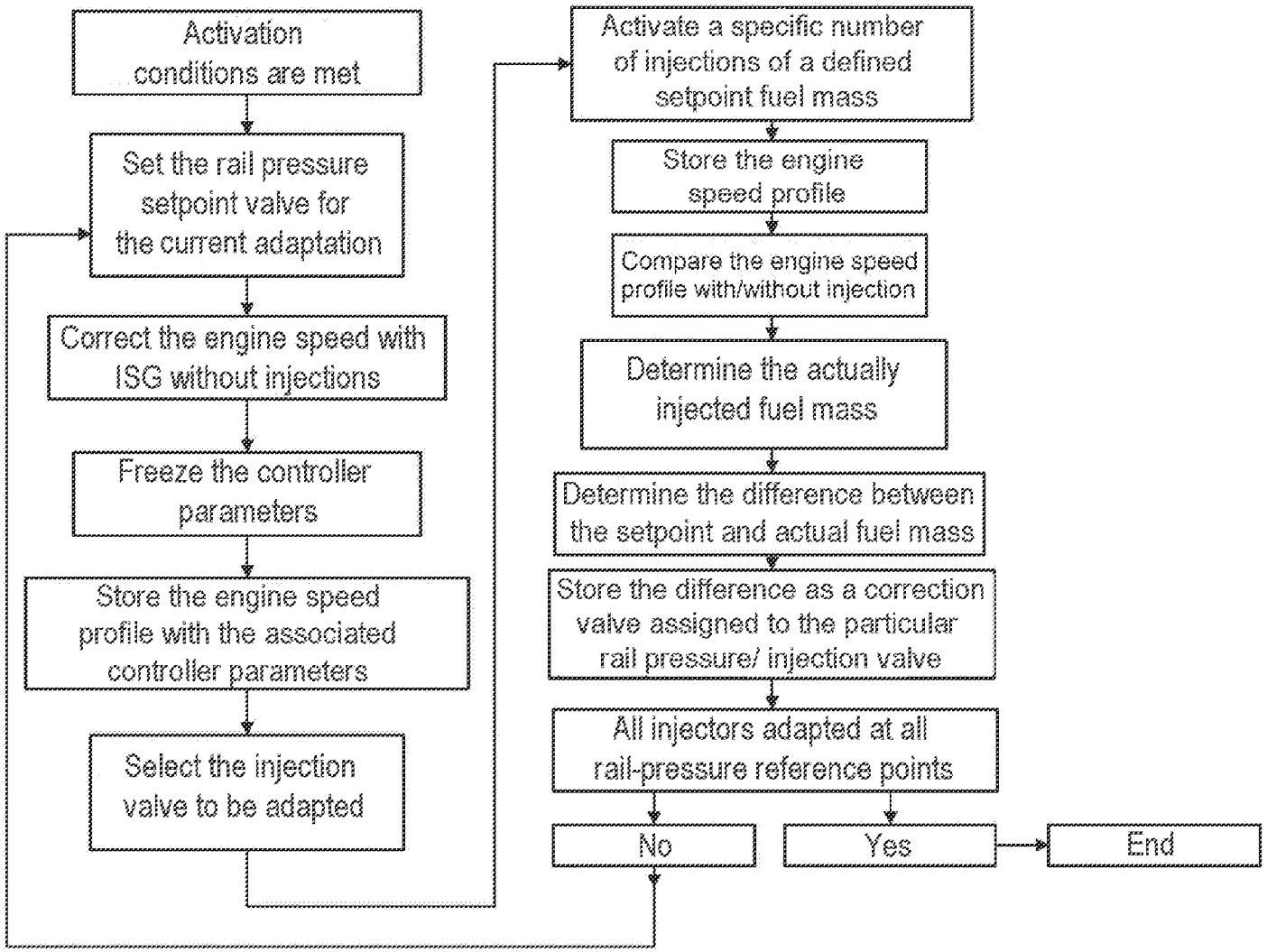
Activation conditions are met
Set the rail pressure setpoint valve for the current adaptation
Correct the engine speed with ISC without injections
Freeze the controller parameters
Store the engine speed profile with the associated controller parameters
Select the injection valve to be adapted
Activate a specific number of injections of a defined setpoint fuel mass
Store the engine speed profile
Compare the engine speed profile with/without injection
Determine the actually injected fuel mass
Determine the difference between the setpoint and actual fuel mass
Store the difference as a correction valve assigned to the particular rail pressure/ injection valve
All injectors adapted at all rail-pressure reference points
No
Yes
End

METHOD FOR ADAPTING AN INJECTION QUANTITY

CROSS-REFERENCE TO RELATED APPLICATIONS

This application is a U.S. National Stage Application of International Application No. PCT/EP2014/057680 filed Apr. 16, 2014, which designates the United States of America, and claims priority to DE Application No. 10 2013 207 555.3 filed Apr. 25, 2013, the contents of which are hereby incorporated by reference in their entirety.

TECHNICAL FIELD

The present invention relates to a method for adapting an injection quantity in injection systems of internal combustion engines of mild hybrid motor vehicles or motor vehicles having a starter generator (SG) or an integrated starter generator (ISG).

BACKGROUND

Injection systems of motor vehicles require intelligent adaptation methods in order to meet the requirements for the course of combustion/emissions/acoustics. In this respect, the system performance in the new state as well as in aged systems is highly significant.

Such adaptation methods are known. For example, a so-called MFMA (minimum fuel mass adaptation) method is known, in which the deviations in the actual and setpoint injection quantities are determined in the minimum quantity range (<3 mg) during the service life of the motor vehicle on the basis of changes in engine speed, and are constantly adapted. According to this method, small quantities of fuel are injected into a cylinder in overrun phases, in which injection normally does not occur, and the change in engine speed is used to calculate the associated injection quantity by reference to models. The correction variables are stored in program maps, on an injector-specific basis for the tested minimum quantities. Such a method is described in DE 102 57 686 A1.

New vehicle functions, such as the sailing mode, for example, pose considerable limitations for the activation of the MFMA method, however, since fewer and fewer overrun phases occur in these cases. As a result, this correction method is activated to a lesser and lesser extent in vehicles of this type, and therefore an adaptation of an injection quantity ultimately no longer takes place. In addition, the application thereof requires a relatively great amount of effort given that there are numerous variations of transmission/clutch.

SUMMARY

One embodiment provides a method for adapting an injection quantity in injection systems of internal combustion engines of mild hybrid motor vehicles or motor vehicles having a starter generator or an integrated starter generator, in which, in an operating phase in which the electric motor of the motor vehicle drives the internal combustion engine thereof, at least one minimum-quantity test injection into a cylinder of the internal combustion engine is performed, the associated injection quantity is determined via the resultant torque and, on the basis thereof, corresponding correction variables for adapting an injection quantity are determined.

In a further embodiment, the method is performed when the internal combustion engine is started.

In a further embodiment, the method is performed when the shut-down internal combustion engine is carried along by the electric motor.

In a further embodiment, the method is performed in the sailing mode.

In a further embodiment, the increase in torque of the internal combustion engine achieved via the test injection is compensated for by regulating the electric motor.

In a further embodiment, the test injection quantity is increased in a stepwise manner and, parallel thereto, the torque of the electric motor at the particular engine cylinder is reduced.

In a further embodiment, the method is performed as a workshop function during idling of the internal combustion engine.

In a further embodiment, the test injection is performed at a constant torque of the electric motor.

BRIEF DESCRIPTION OF THE DRAWINGS

Aspects of the invention are discussed below with reference to FIG. 1, which shows a flow chart of an example method for adapting an injection quantity.

DETAILED DESCRIPTION

Embodiments of the present invention provide a method for allowing minimum fuel adaptation without the need for overrun phases.

Some embodiments provide a method for adapting an injection quantity in injection systems of internal combustion engines of mild hybrid motor vehicles or motor vehicles having a starter generator (SG) or an integrated starter generator (ISG), in which, in an operating phase in which the electric motor of the motor vehicle drives the internal combustion engine thereof, at least one minimum-quantity test injection into a cylinder of the internal combustion engine is performed, the associated injection quantity is determined via the resultant torque and, on the basis thereof, corresponding correction variables for adapting an injection quantity are determined.

In the case of the motor vehicles discussed here, the associated electric motor can start the internal combustion engine and can also carry along the shut-down internal combustion engine. An adaptation of the injection quantity is performed in such systems. The overrun phases necessary for the normal MFMA method are no longer required. Instead, the disclosed method may be used in an operating phase in which the electric motor of the motor vehicle drives the internal combustion engine. The method can be performed not only in the starting phase of the internal combustion engine, but also, in particular, when the shut-down internal combustion engine is carried along by the electric motor (in the sailing mode). The method can also be performed as a workshop function, which has the advantage over the workshop MFMA method performed nowadays that it does not require the dynamic phases of revving-up and therefore functions with substantially greater flexibility and speed.

Another advantage is that the number of variations and, therefore, the amount of effort required for the application thereof is less than for the driving MFMA method. The reason therefor is that the vibration characteristics of the crankshaft are not superimposed by different transmission/converter/gear ratio combinations.

The disclosed adaptation method can be performed, in principle, in the driving mode or in the workshop mode. Two different methods are therefore possible, in principle:

1. regulating the electric motor to a stable rotational speed while simultaneously carrying out test injections, and 2. generating rotational nonuniformity at a constant torque of the electric motor.

One possible embodiment of the aforementioned first variation is the sailing mode. In this case, the engine is decoupled and the vehicle coasts without an additional braking effect from the engine. The internal combustion engine is held at an idling speed by the starter generator (SG) or the integrated starter generator (ISG). In this phase, a test injection into an engine cylinder is performed. The value measured as negative torque (relative to the cycle without injection) during the electronic speed control correlates with the torque indicated by the test injection. The resultant torque can be used to determine the associated injection quantity and, on the basis thereof, corresponding correction variables for adapting an injection quantity can be determined.

The test injection quantity can be increased in a stepwise manner and, parallel thereto, the torque of the electric motor at the particular engine cylinder can be reduced. The increase in torque of the internal combustion engine achieved via the test injection is therefore compensated for by regulating the electric motor.

In another embodiment of the method, such an adaptation procedure is performed as a workshop function during idling. In this case, an engine speed that is stable for the driver is not of great significance. Therefore, fuel may be injected into the individual cylinders at a constant torque of the electric motor in this case. The rotational nonuniformity generated by the combustion correlates with the torque, i.e. with the actually injected fuel mass. The known MFMA algorithm can be used without substantial modifications for such an adaptation method. All that needs to be considered is that the force necessary to move the crankshaft is not supplied via the vehicle drive train, but rather by the associated electric motor.

The above-described variation of the method therefore corresponds to the second method mentioned further above, in which the rotational nonuniformity is generated at a constant torque of the electric motor. This method can be performed with all SG/ISG systems. A precondition for the specified first method is a high-resolution rotational speed/torque regulation of the electric motor over time (which is given for asynchronous motors).

FIG. 1 shows a flow chart of method for adapting an injection quantity. The method, which is presented as an example, relates to the adaptation of an injection quantity in a injection system, which has a plurality of injection valves, of an internal combustion engine of a motor vehicle provided with an integrated starter generator (ISG). When the corresponding activation conditions are met, in a first step, the rail pressure setpoint value for the current adaptation is set. The engine speed with ISG is then corrected without injections. The corresponding controller parameters are then frozen. The engine speed profile is stored with the associated controller parameters.

The injection valve to be adapted is then selected. This is followed by an activation of a specific number of injections of a defined setpoint fuel mass using this injection valve. The resultant engine speed profile is stored and a comparison of the engine speed profile with and without injection is performed. The actually injected fuel mass is determined and the difference between the setpoint and actual fuel mass is determined. The obtained difference is stored as a correction value and is assigned to the particular rail pressure/injection valve.

This method is repeated until all the injectors have been adapted at all rail-pressure reference points. The corresponding adaptation of an injection quantity can be performed using the correction variables obtained.

What is claimed is:

1. A method for adapting an injection quantity in an injection system of an internal combustion engine of a motor vehicle having an electric motor, the method comprising:

after a starting phase of the internal combustion engine and during an operating phase in which the electric motor of the motor vehicle drives the internal combustion engine, performing a minimum-quantity test injection into a cylinder of the internal combustion engine, during a sailing mode of the motor vehicle when the internal combustion engine is decoupled from a drive train and the vehicle coasts without a braking effect from the internal combustion engine, increasing a quantity of the minimum-quantity test injection in a stepwise manner, while increasing the test injection quantity, reducing the torque of the electric motor at a particular engine cylinder, determining a torque of the internal combustion engine resulting from each of the minimum-quantity test injections, determining an actual injection quantity based on the determined torque, determining corresponding correction variables for adapting a target injection quantity based on the determined actual injection quantity, and applying the correction variables to adapt a subsequent injection quantity.

2. The method of claim 1, wherein the minimum-quantity test injection is performed during an idling of the internal combustion engine.

3. The method of claim 2, comprising performing the minimum-quantity test injection at a constant torque of the electric motor.

4. The method of claim 2, comprising controlling the electric motor to maintain the electric motor at a stable rotational speed while performing the minimum-quantity test injection.

* * * * *